United States Patent [19]

Callegari

[11] Patent Number: 4,921,189

[45] Date of Patent: May 1, 1990

[54] UNIVERSAL OUTER POINT LOCK DEVICE FOR RAILWAY POINT

[75] Inventor: Ugo Callegari, Bologna, Italy

[73] Assignee: Sasib S.p.A., Bologna, Italy

[21] Appl. No.: 272,436

[22] Filed: Nov. 17, 1988

[30] Foreign Application Priority Data

Dec. 16, 1987 [IT] Italy ..... 12601 A/87

[51] Int. Cl.[5] ..... E01B 7/02; B61L 11/02; B61L 5/00

[52] U.S. Cl. ..... 246/448; 246/344; 246/401

[58] Field of Search ..... 246/314, 326, 344, 350, 246/358, 401, 415 R, 430, 435 R, 439, 443, 448, 452, 476

[56] References Cited

U.S. PATENT DOCUMENTS 1,550,117 8/1928 Smith ..... 246/401

FOREIGN PATENT DOCUMENTS 2450802 4/1976 Fed. Rep. of Germany ..... 246/443
2525904 12/1976 Fed. Rep. of Germany ..... 246/448
2542202 3/1977 Fed. Rep. of Germany ... 246/435 R
2635231 2/1978 Fed. Rep. of Germany ... 246/435 R
0662394 3/1929 France ..... 246/448
0358825 1/1962 Switzerland ..... 246/435 R
0624813 9/1978 U.S.S.R. ..... 246/401

*Primary Examiner*—Andres Kashnikow
*Assistant Examiner*—Timothy Newholm
*Attorney, Agent, or Firm*—Larson and Taylor

[57] ABSTRACT

The invention relates to an outer point lock device for switchpoints, particularly on high-speed railways. This device comprises two point locks (1, 2) associated each with one of the blades (A1, A2) of the switchpoint. Each point lock comprises a box (3) secured to the corresponding stock-rail (C1, C2) and containing two slides (7, 8) parallel to each other. The slides are superposed on each other and slidably guided across the rails. The so-called lock-slide (8) is connected to the respective blade (A1, A2) and carries a lock member (17, 49) to become locked to the box (3) in the closed position of the blade (A1, A2). The lock slide is coupled to the other so-called drive-slide (7) through a coupling device (28, 29; 249, 307) automatically engageable or disengageable as a result of the overlap stroke of the drive-slide (7) with respect to the lock-slide (8). The drive-slides of the two point locks (1, 2) are connected to each other and to a drive or control rod (44). Each drive-slide (7) is provided with a snap lock device (**10, 11*a*, 11*b*; 45, 11*a*, 11*d*) to lock the slide (7) to the box (3) at the two end positions thereof. Each drive-slide (7) is also provided with means (119, 219; 407) for the direct or indirect actuation of the lock member (17, 49) of the corresponding lock-slide (8**).

6 Claims, 12 Drawing Sheets

F
2
3
13
107
54
8
49
50
149
52
51
53
151
55
103
108
58
158
258
407
11a
11d
48
7
47
45
307
249
208
108
307
249
149
49
52
51
55
151
258
54
53
11a
48
103
58
158
7
47
45
208
407

UNIVERSAL OUTER POINT LOCK DEVICE FOR RAILWAY POINT

SUMMARY OF THE INVENTION

The invention relates to a universal outer point lock device for switchpoints, particularly on high-speed railways.

The invention aims to provide a point lock device ensuring a universal control, i.e. adapted to be controlled as desired either by any electric control box and by a manual control device, and having a great operational flexibility, and more particularly it can be substituted for the presently-used key point lock, type FS 44, wherein the point locking is ensured by the possession of a key, and for the presently-used electric point lock, type FS 55, wherein the point locking is ensured by the positioning of electrical contacts. At the same time, the point lock device should be of a sturdy, simple and inexpensive construction, of easy setup, reliable operation, and it should be exempt—as far as possible—from periodical maintenance.

The point lock device according to the invention comprises two point locks, associated each with one of the blades of the switchpoints and each comprising a box secured, preferably, to the corresponding stock-rail and containing two slides parallel to each other and slidably guided across the rails, and one of which, the so-called lock-slide, is connected to the respective blade and carries a lock member to become locked to the box in the closed position of the blade, while it may be coupled to the other slide, so-called drive-slide, through a coupling device automatically engageable and disengageable as a result of the overlap stroke of the drive-slide with respect to the lock-slide, the drive-slides of the two point locks being connected to each other and to a drive rod, and each drive-slide being provided with a snap lock device to lock said drive-slide to the box at the two end positions thereof, while each drive slide is provided with means for the actuation of the corresponding lock-slide, i.e. for locking it to the box and unlocking it therefrom by means of said overlap stroke of the drive-slide.

By this provision, at each end position of the switchpoints, the opened blade or switchrail is stabilized by locking the lock-slide to the drive-slide and by locking said drive-slide to the box, by means of the respective coupling and snap lock devices, while the closed blade is locked by the engagement (to the box) of the lock member which is provided on the lock slide and is carried and held in this position by the respective actuating means for the drive slide, the latter being stabilized by becoming locked to the box by means of the respective snap lock device, whereas the coupling device between the lock-slide and drive-slide is disengaged. In order to switch the points to the other end position thereof, the drive-slides are moved correspondingly by the drive rod, by first effecting an initial overlap stroke whereby both drive-slides are unlocked from the respective boxes by disengaging the corresponding snap lock devices by overcoming their stabilizing force, while the drive-slide which is associated with the point lock of the closed blade causes the lock member to disengage from the box and, therefore, eliminates the locking of the closed blade, yet without displacing it, coupling together with the lock slide by the respective coupling device on completion of said initial overlap stroke. By continuing said displacement of the two drive-slides, now both coupled, by their coupling devices, with the respective lock-slides, not locked, the latter are displaced by the drive slides together with the blades of the switchpoints to close the now-opened blade. However, the two slides perform an additional final overlap stroke to reach the locked final position where they will be stabilized by engagement to the corresponding boxes through the respective snap-lock devices. During this final overlap stroke the drive-slide of the point lock which is associated with the now-closed blade causes the engagement (to the box) of the locking member on the corresponding lock-slide and, therefore, causes the locking of the closed blade, while on completion of said overlap final stroke the lock-slide of the closed blade and the respective drive-slide are uncoupled from each other by means of the respective uncoupling device.

The point lock according to the invention may be constructed of either the trail-open type (by providing no further mechanical lock between the drive-slides and respective boxes), or the permanent not trail-open type (by providing suitable mechanical locks between the drive-slides and respective boxes), or the selective trail-open type (by providing means to be engaged or disengaged at will, e.g. by an electro-magnet or the like, to lock the drive-slides to the respective boxes).

The point lock device according to the invention may also be provided with any suitable electrical control device which then forms, preferably, an integral portion of each point lock and is housed in a sealed casing, preferably, in a suitable compartment of the box of the respective point lock. Anyway, the boxes of the point lock according to the invention are, preferably, sealed against sand, dust and water.

The point lock device according to the invention may also be provided with a suitable device designed to compensate for the thermal expansion of the blade and/or with detector or feeler means which issues the command only after detecting the presence and/or consistence of the rail stock whereagainst the blade is matched.

The outer point lock according to the invention may be actuated by any control means, more particularly, either manually via a corresponding drive box, or electrically via a suitable electrical drive box. In any case, the two final positions of the point lock device according to the invention are stabilized automatically and regardless of the actuating means, with a force corresponding to the sum of the two forces by which the drive-slides of the two point locks are locked to the corresponding boxes by means of the respective snap-lock devices. Said forces may be changed and matched to the specific requirements by regulating the usually elastic means causing the engagement of the snap-lock devices.

BRIEF DESCRIPTION OF THE DRAWINGS

These and further characteristics of the invention and the advantages resulting therefrom will become apparent from the following description of two embodiments which are shown as non-limiting examples in the accompanying drawings, wherein.

DESCRIPTION OF THE PREFERRED EMBODIMENTS

Figures 1, 2:
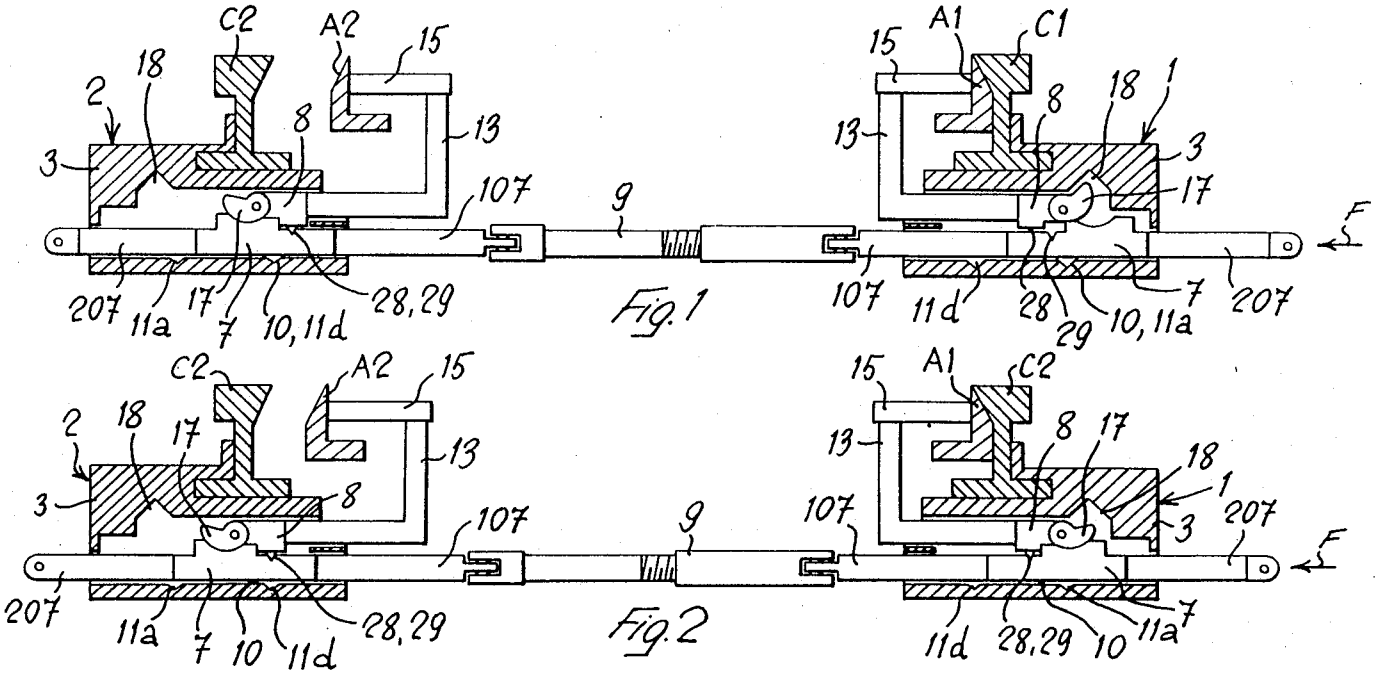
FIGS. 1 to 4 show diagrammatically a first embodiment of the point lock device according to the invention, in four successive operational steps.

The point lock device shown in the FIGS. 1 to 10 comprises two point locks 1 and 2 associated each with one of the blades or switchrails A1, A2 of a railway switch. The two point locks are equal to each other and are disposed in mirror-like opposite positions with respect to the rails. The fitting up is effected, preferably, in the inter-sleeper space, between the first and second tip-bearings of the switchpoints.

Each point lock 1, 2 comprises a sealed box 3 which is mounted under the respective stock rail C1, C2 and is secured to the web thereof by means of a bracket 4 and a bolt 5, while the base of the stock rail C1, C2 is secured to the box 3 by means of suitable stirrups 6.

Slidably mounted on each other in the box 3 are two slides 7 and 8, namely a lower one, so-called drive-slide 7, and an upper one, so-called lock-slide 8. The drive-slides 7 of the two point locks 1, 2 are connected to each other by means of short inner rods 107 secured thereto and a regulatable link-rod 9. At the opposite side, the drive-slide 7 of each point lock 1, 2 is secured to a short outer rod 207 by means of which, in the illustrated exemplary embodiment, the drive-slide 7 of one of the point locks 1, 2 (e.g. the point lock 1) is connected to the switchpoints operating means, for example, an electrical operating box, while the outer rod 207 of the drive-slide 7 of the other point lock 2 may be connected to the switchpoints indicator signal. Arranged between the drive-slide 7 of each point lock 1, 2 and the respective box 3 is a snap-lock device adapted to lock the drive-slide 7 to said box 3 with a certain stabilizing force in both the end positions of the switchpoints. In the exemplary embodiment according to FIGS. 1 to 10, said snap-lock consists of two conical notches 11*a* and 11*d* in the bottom of the box 3 and corrsponding: one (11*a*) to the closed position of the blade A1, A2 and the other (11*d*) to the opened position of the blade A1, A2, and of a pointed pin 10 slidably vertically movable in a corresponding seat in the drive-slide 7 and protruding with its conical end from the undersurface of said drive-slide 7. Said pin 10, by the action of a pressure spring 12, can engage with its lower conical end, at each of the two end positions of the switchpoints, into the corresponding notch 11*a*, 11*d* in the bottom of the box 3, thus locking the drive-slide 7 to said box 3.

Figure 5:
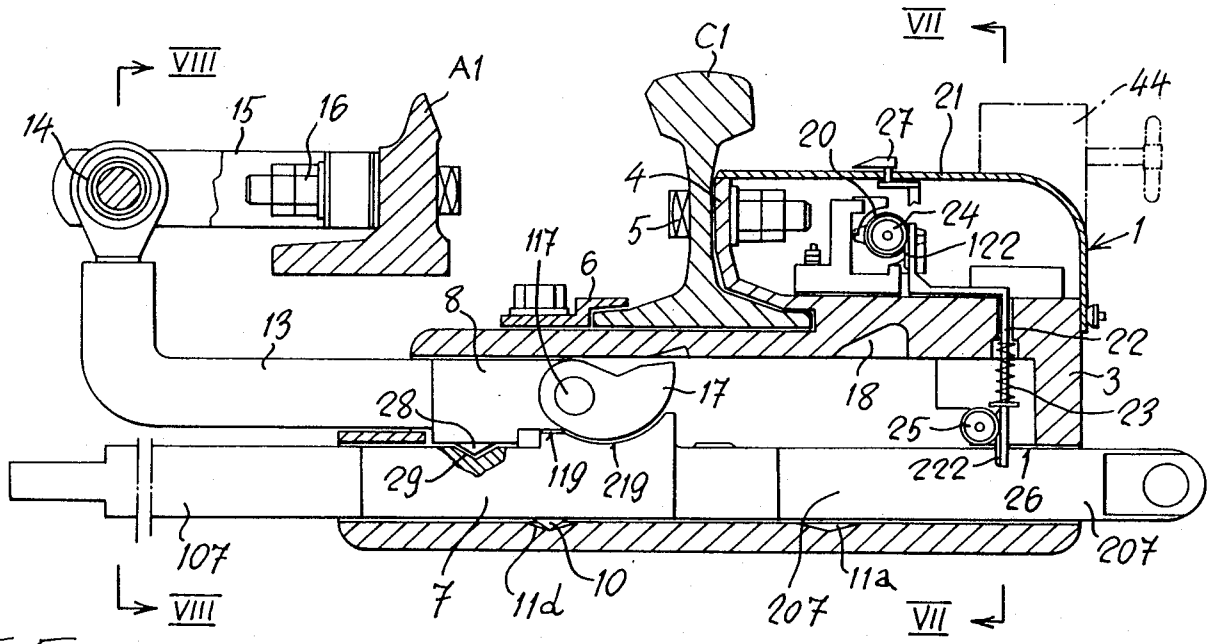
FIGS. 5 and 6 are longitudinal sectional vertical views, on an enlarged scale, of one of the point locks of the device according to FIGS. 1 to 4, in the "opened" blade and "closed" blade condition, respectively.
Figure 6:
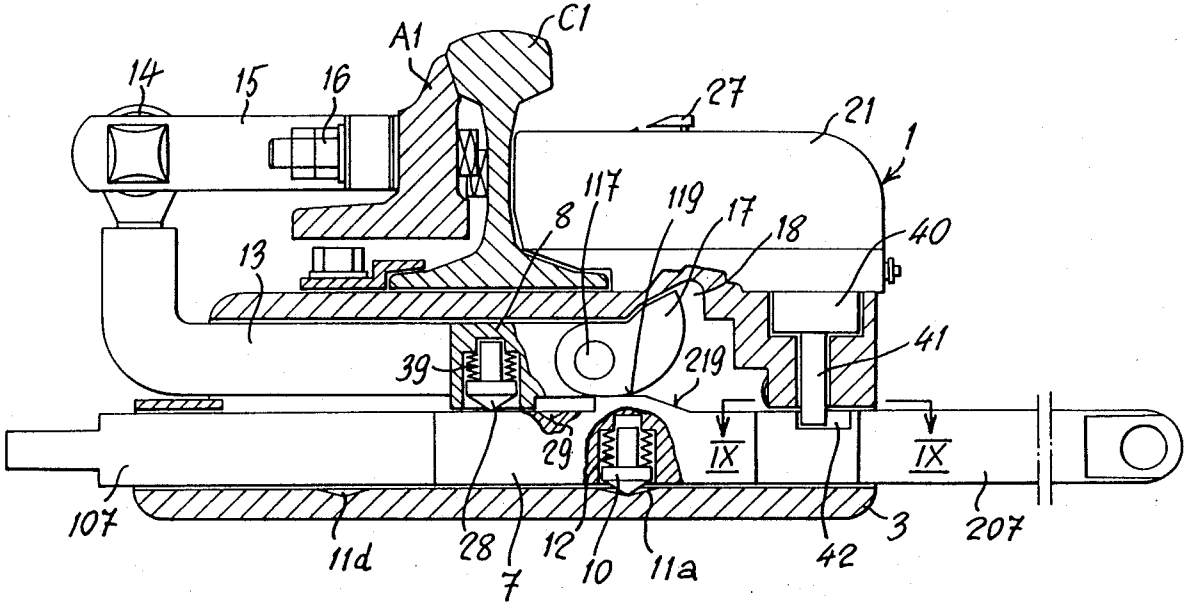
Figure 7:
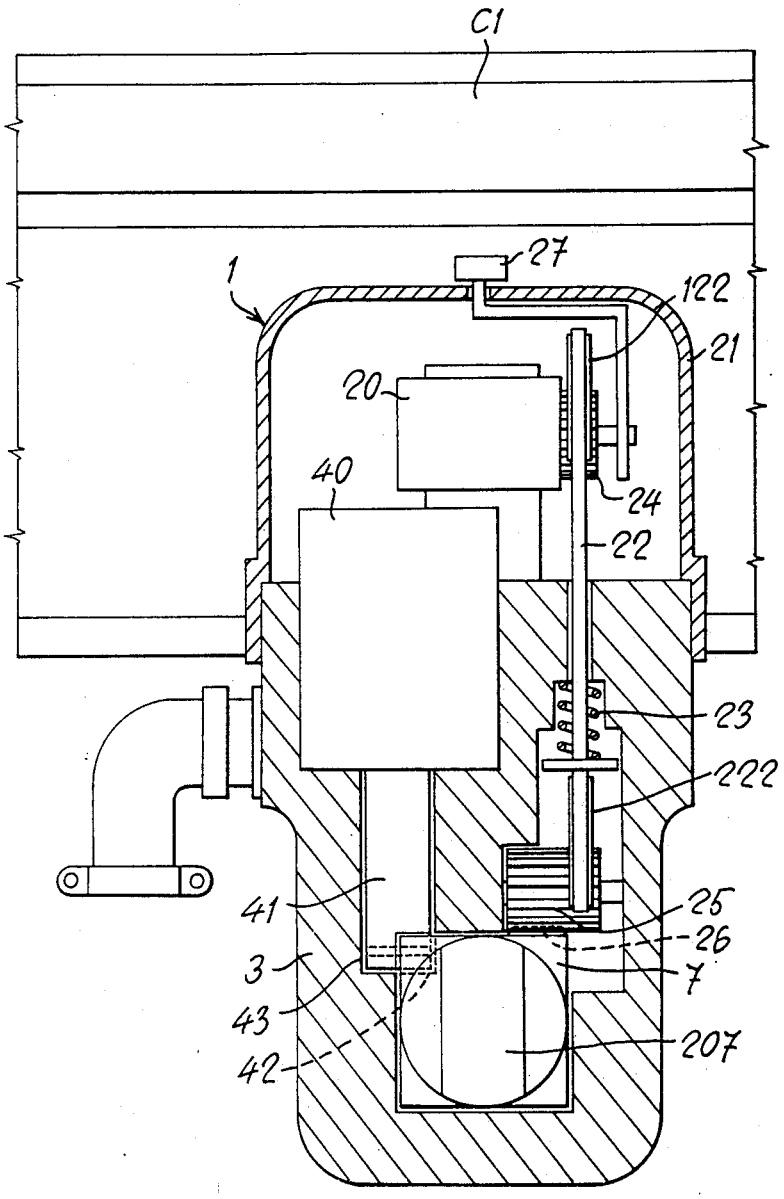
FIGS. 7 and 8 are vertical cross sectional views of the point lock, on the lines VII—VII and VIII—VIII of FIG. 5.
Figure 9:
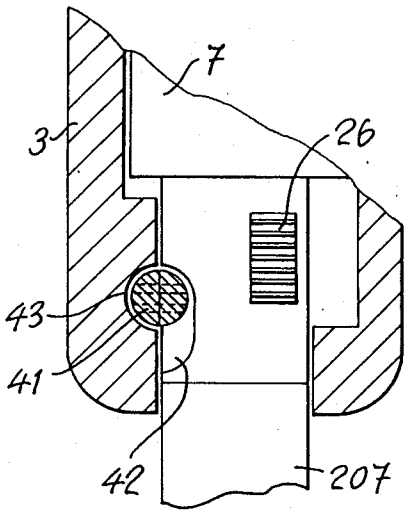
FIG. 9 is a horizontal fragmentary sectional view on the line IX—IX of FIG. 6.
Figure 8:
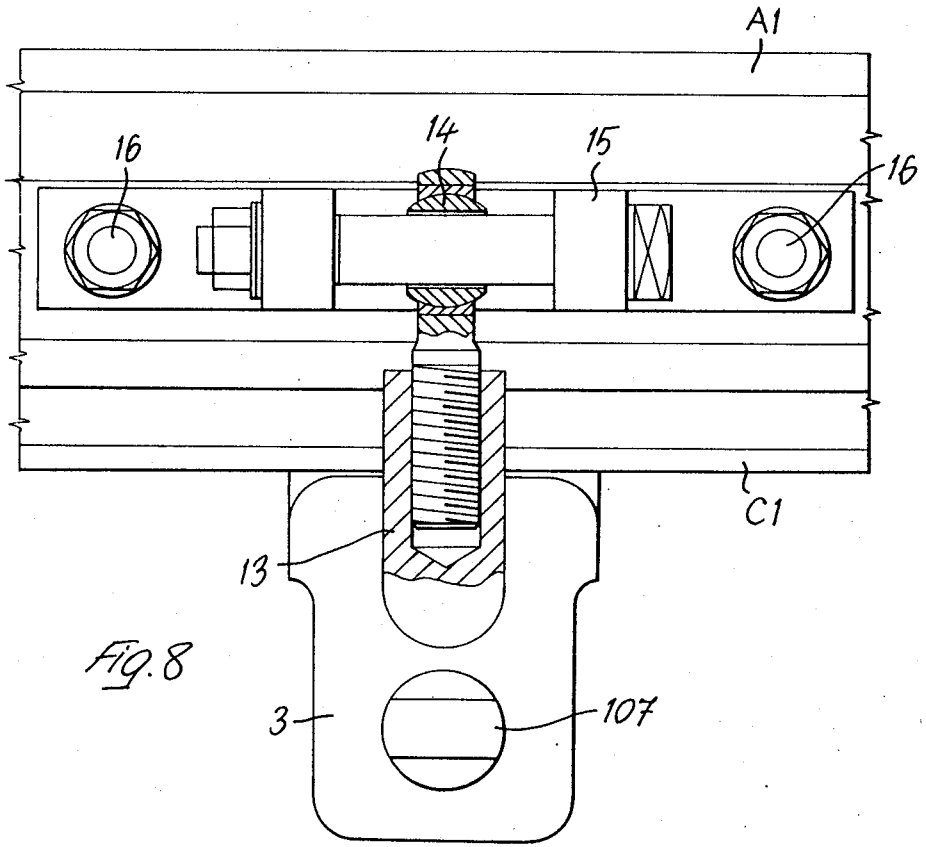
Figure 10:
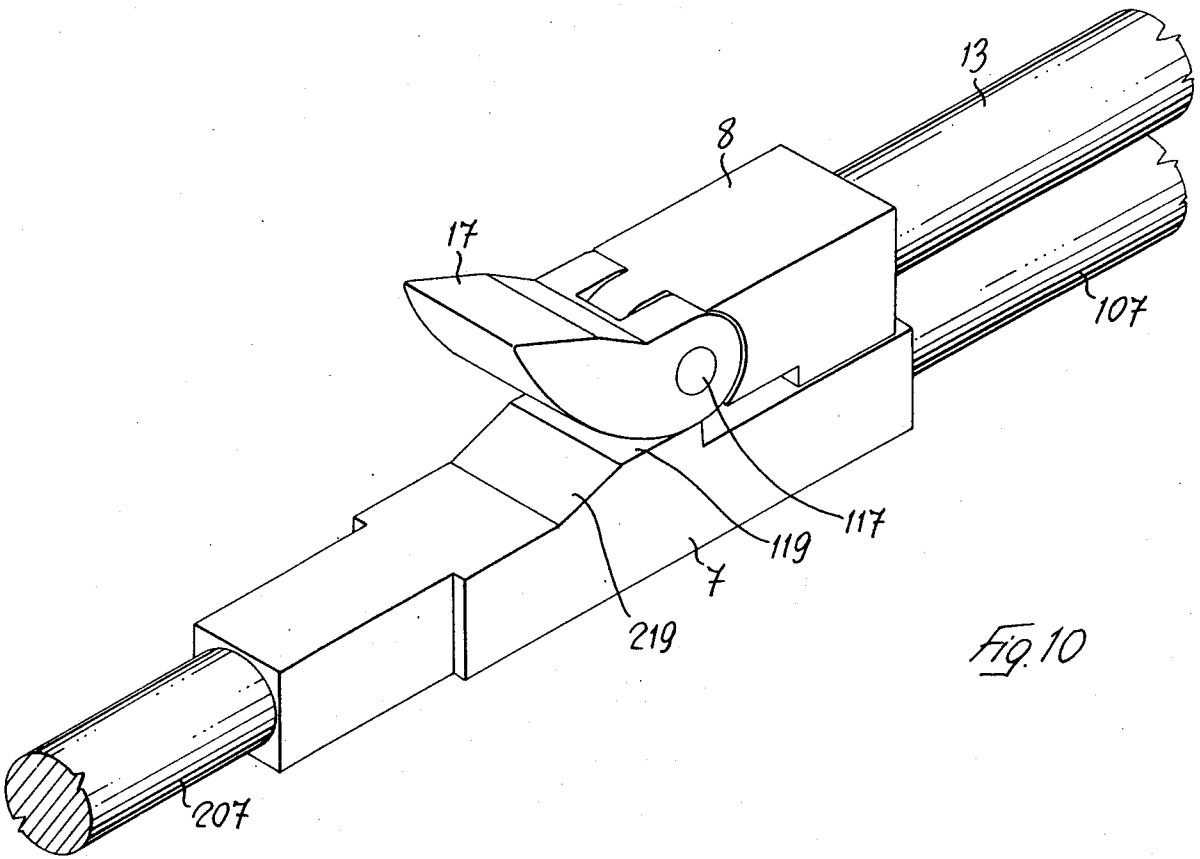
FIG. 10 is a perspective view of the two slides (lock- and drive-slides) of the point lock of the FIGS. 1 to 9.

The lock-slide 8 of each point lock 1, 2 is connected to the respective blade A1, A2 by means of an L-shaped bracket 13 which is pivoted through a ball joint 14 to a leg 15 which is secured to the blade by a pair of bolts 16. Pivoted at the end of the lock slide 8 is a lock pawl 17 which is freely rotatable about a transverse shaft 117 and co-operates with a recess 18 in the upper wall of the box 3. The drive-slide 7 comprises means for actuating said lock pawl 17, consisting—in the embodiment of FIGS. 1 to 10—of two surfaces 119, 219 whereon the lock pawl 17 may rest. One of these surfaces (119) is at a higher level and when disposed under the lock pawl 17 it will lift said pawl angularly so as to engage it into the recess 18 (FIGS. 6 and 10). The other of said rest surfaces (219), however, is at a lower level, either inclined (FIGS. 6 and 10) or cradle-shaped (FIGS. 1 to 5), and when disposed under the lock pawl 17 it permits a downwards rotation thereof to a position wherein it is disengaged from the recess 18 (FIG. 5).

Between the drive-slide 7 of each point lock 1, 2 and the corresponding superposed lock-slide 8 is provided a snap-lock device comprising—in the exemplary embodiment of FIGS. 1 to 10—a notch 29 in the upper surface of the drive-slide 7 and a pin 28 vertically slidably movable in a corresponding seat in the lock-slide 8 and protruding with its conical end from the undersurface of said lock-slide 8, as shown particularly in FIG. 6. The pin 28 is urged downwards by a pressure spring 39, so that it will engage, with a snap action, into the notch 29 in the drive-slide 7 thereunder, when registering with said notch 29.

Each point lock comprises an electrical control unit 20 which may be of any suitable construction, known per se, and is housed in a sealed casing 21 arranged on the top of the box 3. Said control unit 20 may be activated by a rod 22 which is slidably vertically passed through the top wall of the box 3 and is urged in a direction, e.g. downwards, by a pressure spring 23, as shown particularly in FIG. 7. The top end of said rod 22 is provided with a rack 122 meshing with a pinion 24 which actuates the control unit 20. The lower end of the rod 22 is also provided with a rack 222 meshing with a pinion 25 rotatably and idly mounted in the box 3 and meshing with a rack 26 arranged on the top of the drive slide 7 and extending longitudinally thereof, as viewed particularly in FIGS. 5 and 9. Thus, the displacements of the drive-slide 7 are converted into corresponding movements of the control unit 20. Said unit is also provided with a control detector comprising an angularly movable pointer 27 arranged on the top outer surface of the casing 21.

Said point lock device operates as follows:

In the end position of the switchpoints, shown in FIG. 1, the blade A1 is closed and the blade A2 is opened. In the point lock 1 associated with the closed blade A1, the drive slide 7 is locked to the box 3 by means of the lock pin 10 engaged in the corresponding notch 11*a* (see also FIG. 6). The lock pawl 17 rests on the higher actuating surface 119 of the drive-slide 7, whereby it is rotated upwards to be engaged into the recess 18 in the box. The closed blade A1, therefore, is locked and stabilized. The lock pin 28 of the lock slide 8 is disengaged from the respective notch 29 in the drive-slide 7 and rests on the upper surface of said slide 7 in a position offset from the notch 29 towards the opposite point lock 2. Also in the point lock 2 associated with the opened blade A2, the drive-slide 7 is locked to the box 3 by means of the lock pin 10 engaged in the corresponding notch 11*d*. The lock pawl 17 is in its lowered position disengaged from the recess 18 because it is on the lower actuating surface 219 of the drive-slide 7. The lock-pin 28 of the lock-slide 8, however, is engaged in the notch 29 of the drive-slide 7, whereby the two slides 7, 8 are coupled to each other. The opened blade A2 is, therefore, stabilized.

Figures 3, 4:
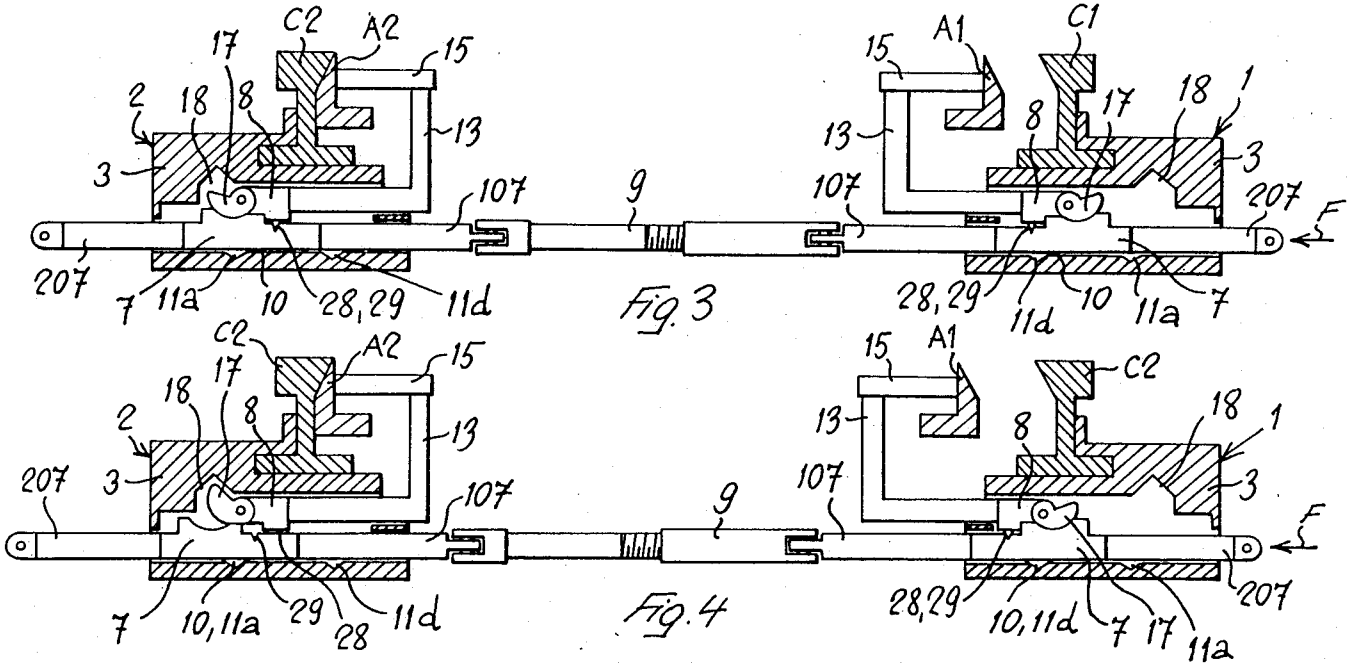

In order to switch the points to the other end position thereof, shown in FIG. 4, the drive-slides 7 of both point locks 1 and 2 are moved in the direction of the arrow F, overcoming the stabilizing force originated by the lock pins 10 and disengaging said pins 10 from the respective notches 11*a*, 11*d*, i.e. unlocking the two drive slides 7 from the respective boxes 3. During the first part of this movement of the two drive-slides 7, so-called initial overlap stroke, on completion of which the switchpoints and point lock device are in the intermediate position of FIG. 2, the drive-slide 7 of the point lock 2 associated with the blade A2 which was opened up to now, displaces correspondingly said blade A2 towards the respective stock rail C2, the drive-slide 7 being coupled to the lock-slide 8 by means of the coupling pin 28 engaged in the notch 29. On completion of the initial overlap stroke, the previously opened blade A2 assumes an intermediate not-stabilized position. On the other hand, in the point lock 1 associated with the previously-closed blade A1, the drive-slide 7 moves with respect to the lock-slide 8 and brings its lower actuating surface 219 in registry with the lock pawl 17 which falls down and disengages from the recess 18 of the box 3. On completion of the initial overlap stroke (which may be of the order of 40 mm), the notch 29 of the drive-slide 7 will be in registry with the coupling pin 28 of the lock-slide 8, and said pin will engage into said notch 29 and thus it locks together the two slides 7 and 8. The still closed blade 1 is no longer locked or even stabilized.

During the further mevement of the two drive-slides 7 in the direction of the arrow F, both blades A1, A2 of the switchpoints are displaced, the lock-slides 8 being coupled to the drive-slide 7 to reach, e.g. after a stroke of the order of 150 mm, the position shown in FIG. 3, wherein the blade A2 is now closed against the respective stock-rail C2, but is not yet locked or stabilized, while the blade A1 is not yet completely away from the respective stock-rail C1.

The two drive-slides 7, then perform a final overlap stroke (e.g. of the order of 40 mm) before reaching the end position of FIG. 4 wherein both drive-slides 7 are locked again to the box 3 and are stabilized by means of the lock-pins 10 which snap into the respective notches 11*a*, 11*d*. During this final overlap stroke, the drive slide 7 of the point lock 1 associated with the now-opened blade A1, displaces said blade A1 from the position of FIG. 3 to the fully opened position, preserving the connection between the two slides 7 and 8 by the engagement of the pin 28 in the notch 29, whereby the blade A1 is stabilized in its fully-opened position (see also FIG. 5). In the point lock 2 associated with the now-closed blade A2, the lock-slide 8 remains locked in its position of FIG. 3, because the already closed blade A2 is urged against the respective stock rail C2. Therefore, at the beginning of the final overlap stroke, the drive-slide 7 disengages from the lock-slide 8, overcoming the coupling force originated from the coupling pin 28 engaged in the notch 29, i.e. exerting a detecting or feeling force to detect the presence and resistance of the stock rail C2 against which the closed blade A2 is matched. After moving the coupling pin 28 of the lock-slide 8 out of the notch 29, during the further final overlap stroke, the drive-slide 7 brings its higher actuating surface 119 under the lock pawl 17, so that it lifts angularly said pawl 17 and engages it into the corresponding recess 18 of the box 3. The now-closed blade A2 is thus locked and stabilized.

It is also apparent from the above description that the point lock device according to the FIGS. 1 to 10 is of the trail-open type. In fact, when upon the trail-open step the opened blade, e.g. the blade A2 in FIG. 1, is moved towards the respective stock rail C2, it drags the drive-slide 7 of the associated point lock 2, the lock-slide 8 being coupled to the drive-slide 7 by means of the pin 28 engaged in the corresponding notch 29. Together with the drive-slide 7 of the point lock 2 is also dragged the drive-slide 7 of the opposite point lock 1 which is associated with the closed blade A1. This drive-slide 7, therefore, performs first its overlap stroke whereby it causes the lock pawl 17 to swing downwards, thus disengaging it from the recess 18 of the box 3 and, therefore, unlocking the closed blade A1. On completion of the overlap stroke of the drive-slide 7, the latter is coupled to the lock-slide 8 by the action of the coupling pin 28 and corresponding notch 29 and, therefore, it drags the lock-slide 8 and blade A1 along in its further movement.

However, the point lock device of the FIGS. 1 to 10 may also be selectively made of the not trail-open type by means of an electro-magnet 40 (FIGS. 6, 7 and 9) provided in each point lock 1, 2 and actuating a vertically movable pin 41 adapted to engage, in its lowered position shown in the figures, partly into a recess 42 of the drive slide 7 and partly into a recess 43 of the box 3. Thus, the drive slide 7 is locked to the box 3.

Each point lock 1, 2 may be equipped with an "FS" lock device, shown with dot-and-dash lines at 44 in FIG. 5.

The point lock device of the embodiment shown in the FIGS. 11 to 16 is based on the same principles as the embodiment according to FIGS. 1 to 10 and it has the same operation, and the parts which are equal or equivalent to those already described are designated by the same reference numerals. The point lock device according to FIGS. 11 to 16 also comprises two point locks 1, 2 associated each with switchblades A1, A2 and consisting each of a sealed box 3 arranged under the respective stock rail C1, C2 and secured thereto by a bracket 4 and a bolt 5. The bracket 4 is pivoted to the box 3 by means of a pin 104. Within the box 3 of each point lock 1, 2 the two slides 7 and 8 are slidably giuded on each other. The lower slides, so-called drive-slides 7 of the two point locks 1, 2, are connected to each other by means of their inner tierods 107 and of a connecting tierod 9, which is connected to a control tierod 44. The upper slide, so-called lock-slide 8, is connected to the respective blade A1, A2 by means of a bracket 13 pivoted at 14 to a leg 15 which is fixed to the blade A1, A2 by means of two bolts 16.

In the embodiment of FIGS. 11 to 16, the snap-lock device between the drive-slide 7 and box 3 comprises two side lock-pins 45 which are slidable transversely to the drive-slide 7 in a corresponding seat thereof and are both urged outwards by an interposed pressure spring 46. Each lock-pin 45 carries, on the outer side thereof, a roller 47 having a vertical axis and protrudes from the corresponding side of the drive-slide 7. At each of the end positions of the drive-slide 7, the rollers 47 of the two lock-pins 45 snap into corresponding notches 11*a*, 11*d* provided in side guide bars 48 which are secured to the box 3.

The device for coupling the drive-slide 7 and lock-slide 8, and the device for blocking (locking) the lock-slide 8 and, therefore, the respective blade A1, A2 in the closed position to the box 3, are constituted by a single lock-member 49 which is accommodated between the two arms 108 of the lock-slide 8 which has a fork-like construction. The lock-member 49 is pivoted vertically with the end of its stem at 50 to the pair of arms 108 of the lock slide 8 and is formed, at the free opposite end thereof, with an enlarged head constituting an upper detent 149 and a lower detent 249. The lower detent 249 co-operates with a top step 307 of the underlying drive-slide 7, while the upper detent co-operates with the edge of a slot 53 formed in a plate 54 secured to the box 3. The lock member 49 is of hollow formation and it slidably accommodates a pin 51 which is urged outwards by a pressure spring 52. The lock-member 49 has a V-shaped pointed end 151 protruding from the head of the lock-member 49 to co-operate with a roller 55 which is rotatably mounted between the two arms 108 of the fork-like portion of the lock slide 8. The arrangement is such that said lock-member 49 may alternately assume a locking angular position, directed upwards, wherein its upper detent 149 is engaged in the slot 53 of the overlying stationary plate 54 (FIGS. 12 and 13), and an angular position to couple the lock-slide 8 and drive-slide 7, wherein said lock-member 49 is directed downwards and its lower detent 249 may engage with the step 307 of the drive-slide 7 (FIG. 14). The lock-member 49 is held in both angular positions by a spring-loaded pin 51 urging against a roller 55 by either of the inclined faces of its V-pointed end 151. In order to be shifted from one angular position to the other, the lock-member 49 should overcome a certain force and snap the apex of the V-pointed end 151 of the pin 51 from one side to the other of the roller 55. This force may be different for the two shift directions of the lock-member 49 depending upon the configuration (planar, convex or concave) of the two inclined faces of the V-pointed end 151 of the pin 51.

The lock slide 8 comprises at the arms 108 of its fork-shaped portion lower abutment steps 208 co-operating with corresponding abutment steps 407 of the underlying drive-slide 7. The two abutment steps 407 of the drive-slide 7 are laterally offset with respect to said step 307. In the exemplary embodiment shown in FIG. 16, the two abutment steps 208 of the lock-slide 8 are formed in the lower edge of two plates 56 which are secured on the outer sides of the two arms 108 of the fork shaped portion of said slide 8.

Figure 11:
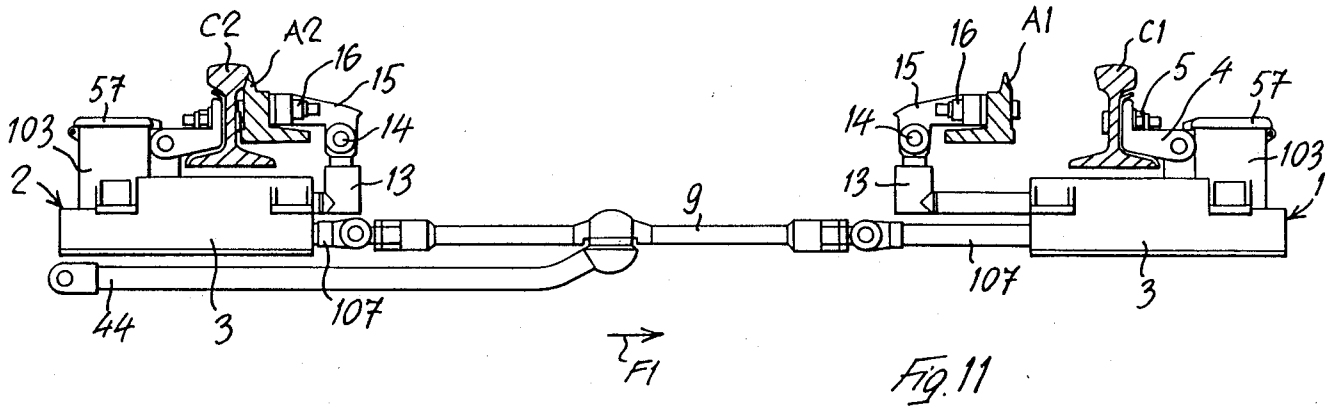
FIG. 11 shows diagrammatically a second embodiment of the point lock device according to the invention.
Figure 12:
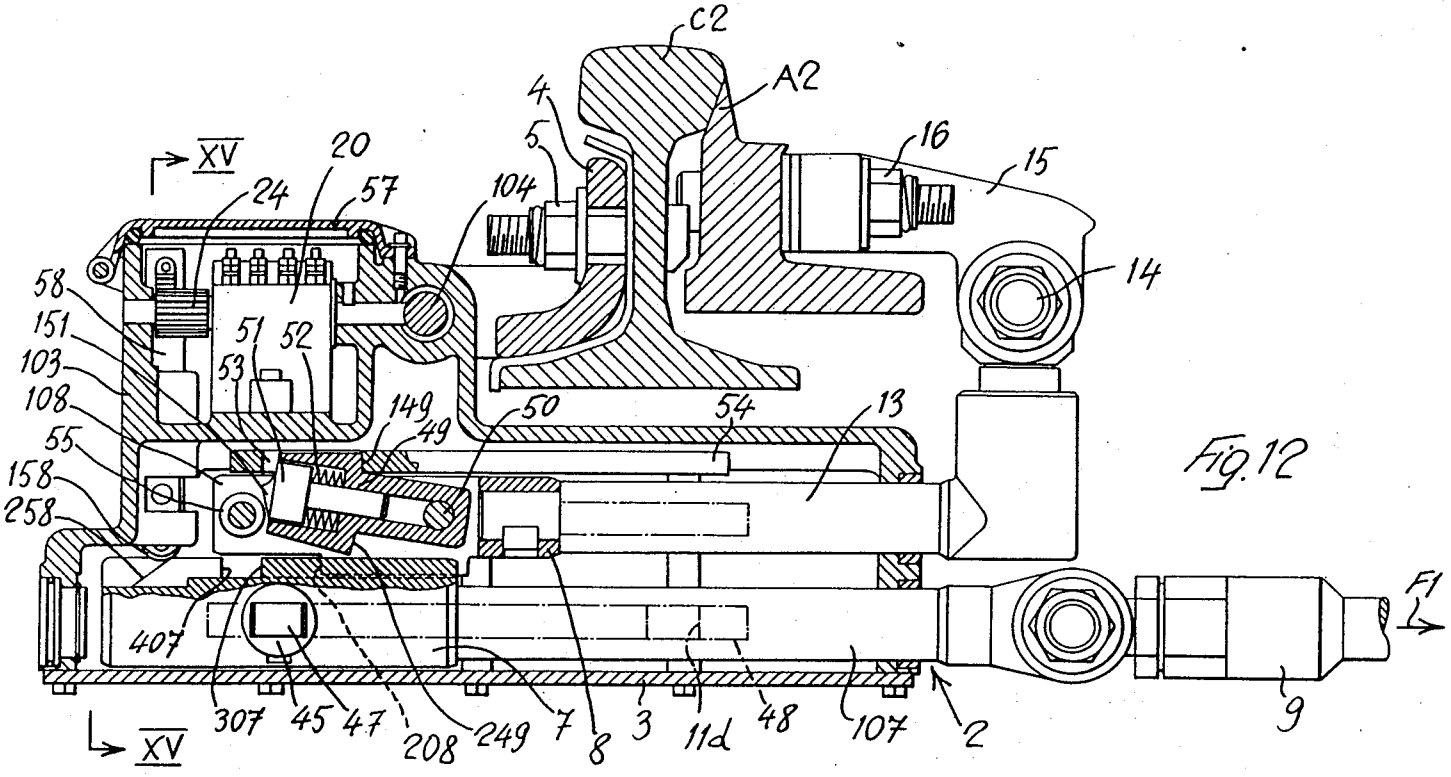
FIG. 12 is a longitudinal vertical sectional view, on an enlarged scale, of one of the point locks of the device of FIG. 11, in the closed blade condition.
Figures 13, 14:
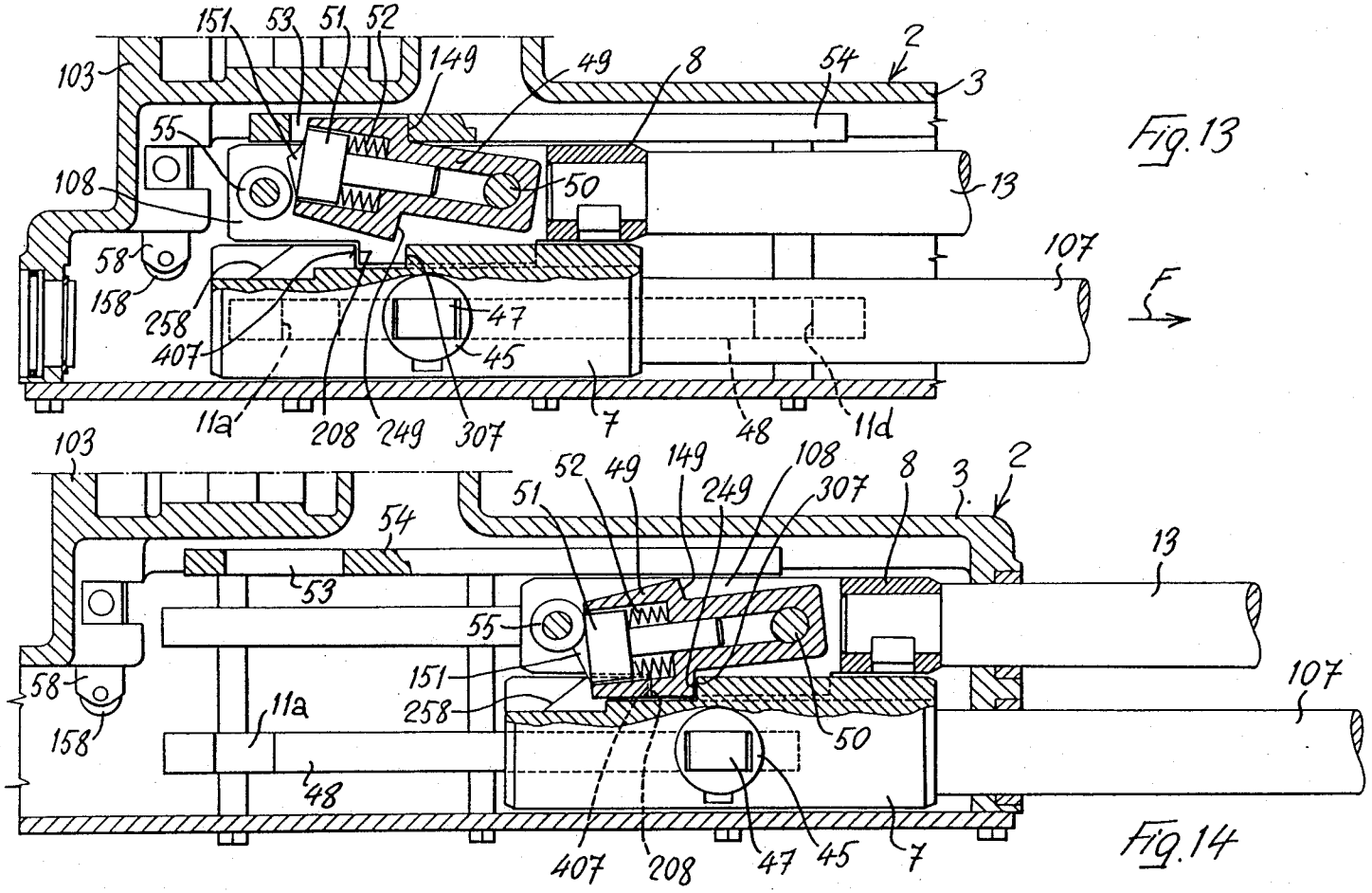
FIGS. 13 and 14 show a portion of the sectional view of FIG. 12, in two successive operational steps to the opened blade condition.
Figure 15:
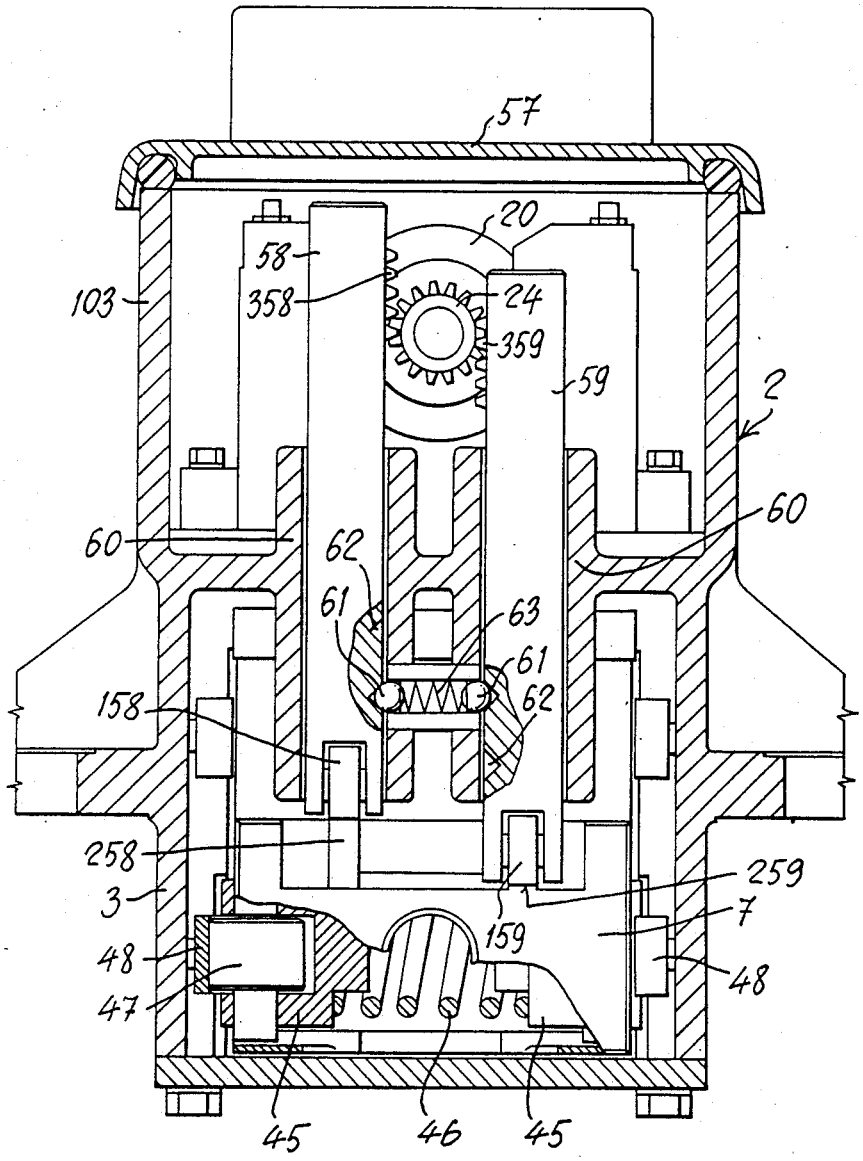
FIG. 15 is a vertical cross sectional view, on an enlarged scale on the line XV—XV of FIG. 12.

Also in the embodiment of FIGS. 10 to 16, each point lock 1, 2 is provided with an electrical control unit 20 housed in a sealed compartment 103 integral with the box 3 and sealingly closed by means of a top cover 57 (FIGS. 12 and 15). The actuating pinion 24 for the control unit 20 is activated by means of two vertical tappet rods 58 and 59, vertically slidably guided in corresponding tubular guides 60 passed through the bottom of the compartment of the box 3. The upper end portions of the two tappet rods 58, 59 are provided each with a vertical rack 358, 359, and said two racks 358, 359 are in mesh—at diametrically opposite sides—with the actuating pinion 24 for the control unit 20. The lower end of each tappet rod 58, 59, on the other hand, carries a roller 158, 159 which co-operates with a corresponding inclined actuating surface 258, 259 formed on the top side of the drive-slide 7. These two actuating surfaces have the same angle of inclination but in opposite directions, whereby when the tappet rods 58, 59 rest through their bottom rollers 158, 159 on the respective inclined actuating surfaces 258, 259 and the drive-slide 7 moves in one direction, e.g. rightwards in FIGS. 12 and 16, one of the rods 58, 59—e.g. the rod 58—will move downwards, while the other one—e.g. the rod 59—will move upwards with a synchronous movement, and therefore the pinion 24 of the control unit 20 is rotated in a given direction, e.g. in a counterclockwise direction in FIG. 15. When the drive-slide moves in the opposite direction, e.g. leftwards in FIGS. 12 and 16, the opposite synchronous movement of the two tappet rods 58, 59 is reversed and the actuating pinion 24 of the control unit 20 is rotated in the opposite direction, e.g. in a clockwise direction in FIG. 15.

During its movement, the drive-slide 7 moves away from the two tappet rods 58, 59 to such an extent whereby the latter are no longer supported by the corresponding inclined actuating surfaces 258, 259 of the drive-slide 7 (FIGS. 13 and 14). As a result, the two tappet rods 58, 59 are locked and stabilized, the former in a raised position and the latter in a lowered position, or vice versa, by means of snap detent balls 61 which will engage into corresponding notches 62 in the rods 58, 59 by the action of an interposed pressure spring 63 (FIG. 15).

The point lock device according to FIGS. 11 to 16 operates as follows:

In the end position of the switchpoints as from FIG. 11, the drive-slides 7 of both point locks 1, 2 are locked to the respective boxes 3 in the corresponding end positions (FIG. 12 for the point lock associated with the closed blade A2, and FIG. 14 for the point lock associated with the opened blade A1) by means of the respective side pins 45 engaging one of the two pairs of notches in the side guide bars 48, more particularly in the notches 11*a* on the side of the closed blade A2 (FIG. 12) and in the notches 11*d* on the side of the opened blade A1. In the point lock 2 associated with the closed blade A2 (FIG. 12), the lock member 49 is in its raised angular position wherein the upper detent 149 of said lock member 49 is engaged with the edge of the slot 53 of the plate 54 and thus it locks the lock-slide 8 to the box 3. The closed blade A2, therefore, is locked and stabilized. The slide abutment steps 407 of the drive-slide 7 are spaced from the corresponding side abutment steps 208 of the lock-slide 8. In the lock-slide 1 associated with the opened blade A1, however, the lock member 49 is in its lowered angular position wherein it is engaged through its lower tooth 249 with the step 307 of the drive-slide 7, as shown in FIG. 14 for the other end position of the point lock 2. The two slides 7 and 8 on the side of the opened blade, therefore, are coupled with each other by the lock member 49. The two upper steps 407 of the drive-slide 7 become engaged with the corresponding lower side steps 208 of the lock-slide 8. The opened blade A1, therefore, is stabilized by virtue of the locking of the corresponding drive-slide 7 to the box 3 of the point lock 1 by means of the side lock-pins 45.

To shift the point lock to the other end position, the drive-slides 7 of the two point locks 1, 2 are displaced by means of the control tierod 44 in the direction of the arrow F1 in FIG. 11, overcoming the resistance (stabilizing force) required to disengage the lock-pins 45 from the respective notches 11*a*, 11*d*. The drive-slides perform first a short initial overlap stroke during which, on the side of the opened blade A1, the drive-slide 7 drags correspondingly the lock-slide 8 coupled therewith together with said blade A1. On the side of the closed blade A2, however, the drive-slide 7 moves relatively to the lock-slide 8 as far as its side abutment steps 407 will engage the corresponding lower side abutment steps 208 of the lock-slide 8, as shown in FIG. 13. Therefore, during the further movement of the drive-slide 7, the latter drags as well the lock-slide 8 in the direction of the arrow F1, whereby the lock-member 49 is snappingly moved into its angular lower position, as a result of the pressure of its upper detent 149 against the edge of the slot 53 in the top plate 54 and of the corresponding torque with respect to the fulcrum 50 of said lock member 49. Thus, the lock member 49 disengages from the plate 54 and releases from the box 3 the lock-slide 8 and, therefore, the closed blade A2, while engaging by means of its lower detent 249 with the corresponding intermediate step 307 of the drive-slide 7, thus causing the inter-engagement of the two slides 7 and 8, as shown in FIG. 14.

During the further movement of the two drive-slides 7 in the direction of the arrow F1, the latter will drag the respective lock-slides 8, coupled therewith, thus bringing the previously opened A1 to its closed position against the respective stock rail C1, while the previously closed blade A2 is switched to a not yet fully opened position away from the respective stock rail C2.

The drive-slides 7 of the two point locks 1, 2 perform at last a short final overlap stroke on completion of which they reach their opposite end positions and are locked to the respective boxes 3 by means of the snap lock pins 45 engaging into the respective notches 11*a*, 11*d*. By this final overlap stroke, the now-opened blade A2 is switched to its fully-opened position, without affecting the mutual engagement of the two slides 7 and 8, as shown in FIG. 14. In the point lock 1 corresponding to the now-closed blade A1, the drive-slide 7 performs its final overlap stroke with respect to the lock-slide 8 which is blocked as a result of the closure of the respective blade A1 onto the stock rail C1. During this final overlap stroke, the drive-slide 7 exerts—by its intermediate upper step 307—a pressure against the lower detent 249 of the lock member 49 which was up to now in its angular lowered position, whereby said lock member 49 is snapped angularly upwards from the position of FIG. 14 to the position of FIG. 13, whereby its upper detent 149 will engage the edge of the slot 53 of the top plate 54 so as to lock the lock-slide 8 to the box 3, i.e. to lock the now-closed blade A1. The elastic resistance opposed by the pin 51 in passing with its V-pointed end 151 from the lower side to the upper side of the roller 55 must be overcome by a corresponding pressure of the drive-slide 7 against the lower detent 249 of the lock member 49. This pressure is transferred through the lock-slide 8 and the respective blade A1 now closed against the corresponding stock rail C1, and it constitutes the "detection" to feel the presence and the resistance of said stock rail C1.

By the following last fraction of the final overlap stroke after said engagement of the lock-slide 8, the drive-slide 7 of the point lock 1 on the side of the now-closed blade A1 moves from the position of FIG. 13 to the final position of FIG. 12, moving away accordingly its side upper abutment steps 407 from the respective side lower abutment steps 208 of the lock-slide 8.

Of course, the point lock of the FIGS. 11 to 16 may also be of the trail-open, or not trail-open, or selectively trail-open types, for example, by means of an electromagnet as described in connection with the embodiment of FIGS. 1 to 10, or in any other suitable manner.

I claim:

1. A universal outer point lock device for a railway switch having respective blades associated with respective rails at the switchpoint, said outer point lock device comprising:

two point locks, each said point lock associated with a respective blade and comprising:

a box secured to the associated rail and having a box detent, a lock-slide in said box connected to the associated blade and disposed perpendicularly to a vertical plane of the associated rail, said lock-slide having a transverse roller mounted thereto, a drive-slide adjacent and parallel to said lock-slide in said box, a guide means for guiding said lock-slide and said drive-slide in a sliding movement in said box, a coupling means for automatically engaging said lock-slide to said drive-slide with an overlap stroke being provided for movement of said drive-slide relative to said lock-slide during the sliding movement thereof to and from a closed end position where the associated blade is against the associated rail and an open end position where the associated blade is away from the associated rail, a lock member mounted to said lock-slide, said lock member including a head at one end, a spring-loaded pin mounted in said head and adjacent said transverse roller of said lock-slide, a lock detent on one side of said lock member, a pivot means for pivotally mounting said lock member to said lock-slide about which said lock member is swingably attached for pivoting motion in a direction transverse to the sliding movement of said lock-slide whereby said lock member is swingable between (a) a first position where said lock detent engages said box detent of said box and said spring-biased pin is adjacent one side of said transverse roller, and (b) a second position where said lock detent is disengaged from said box detent and said spring-biased pin is adjacent an opposite side of said transverse roller after having biasingly engaged said transverse roller in snappingly moving from one side to the opposite side, a snap lock device which locks said drive-slide to said box at the two end positions of movement of said drive-slide, and an actuation means for actuating said lock detent of said lock member into engagement with said box detent when said lock-slide is moved by said drive-slide from the open position to the closed position and out of engagement with said box detent when said lock-slide is moved by said drive-slide from the closed position to the open position; and a drive rod interconnecting said drive slides of each said point lock so that said drive-slides move together.

2. A point lock according to claim 1, characterized in that: the pivot means includes a shaft (50) transverse to the direction of movement of said lock slide; the lock member includes a second detent (249) on another side of said lock member; a drive detent is provided on said drive-slide adjacent said lock member; and the box detent is an edge of a slot provided in a portion attached to said box such that said lock member assumes alternately an angular raised position wherein said lock detent (149) becomes locked with the edge of the slot (53) in the portion (54) secured to the box (3) and causes the locking of the lock-slide (8) and respective blade (A1, A2), as well as an angular lowered position wherein said lock member disengages said lock detent (149) from said slot (53) and becomes engaged through said second detent (249) with the drive detent (307) of the drive-slide (7), whereby the drive-slide is locked to the lock-slide (8) (FIGS. 12 to 16).

3. A point lock according to claim 2, characterized in that the drive-slide (7) comprises dragging drive abutments (407) and said lock slide (8) includes adjacent lock abutments (208) whereas said drive abutments become engaged with said lock abutments (208) of the lock-slide (8) on completion of an initial overlap stroke from the closed end position of the drive-slide (7), and whereas said drive abutments move away from said lock abutments (208) of the lock-slide (8) as a result of a final overlap stroke of the drive-slide (7) to the closed end position.

4. A point lock device according to claim 1, characterized in that each point lock (1, 2) comprises an electric control unit (20) which is activated by the corresponding drive-slide (7) and a sealed casing (21, 103) forming a part of the box in which said electric control unit is housed.

Figure 16:
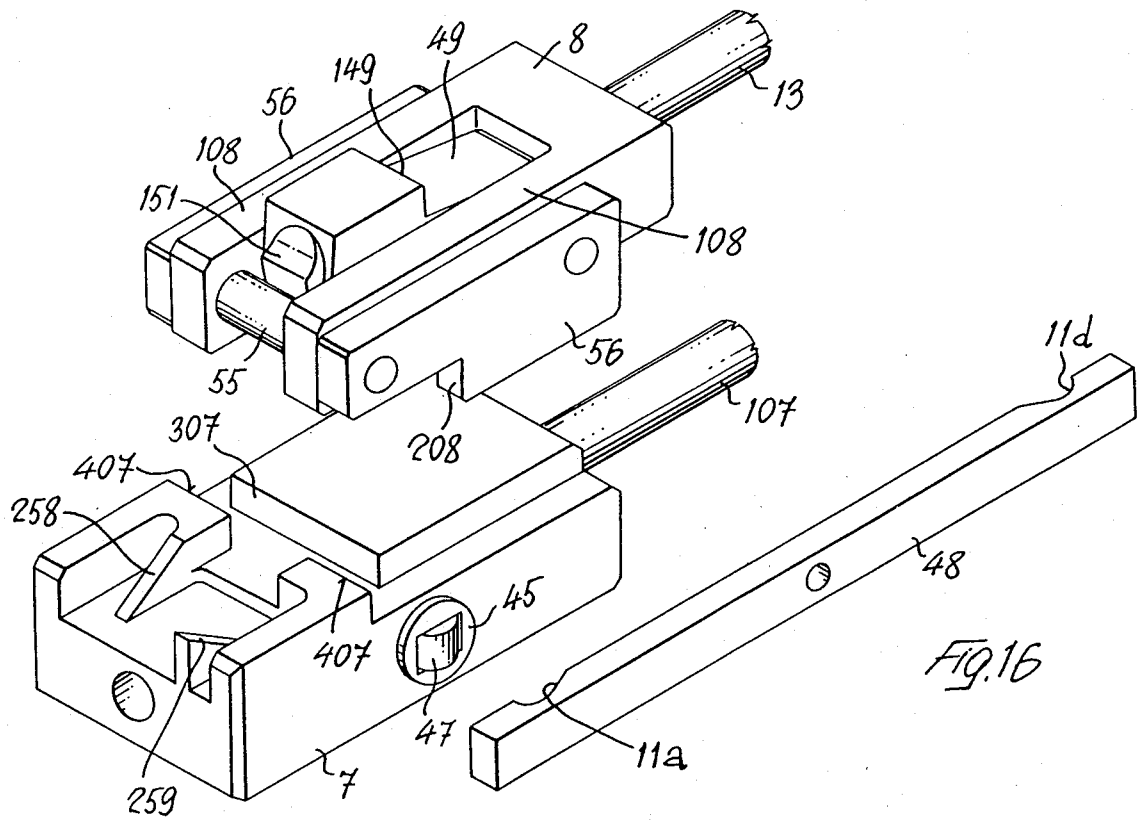
FIG. 16 is an exploded perspective view of the two slides (lock- and drive-slides) of the point lock of FIGS. 11 to 15, with an associated stationary portion of the snap-lock device of the drive-slides.

5. A point lock according to claim 4, characterized in that: a control pinion (24) is connected to the control unit and actuates the electric control unit (20); two tappet rods (58, 59) which are vertically slidably guided on opposite slides of said control pinion include respective racks which engage said control pinion; and two corresponding surfaces (258, 259) are formed on the drive-slide (7) having oppositely-directed inclinations such that respective said tappet rods engage respective said inclined surfaces whereby said tappet rods are synchronously actuated in opposite directions (FIGS. 15 and 16).

6. A point lock according to claim 1, characterized in that a recess is provided in said drive-slide; a pin (51) is mounted to said box for movement into and out of said recess; and an electro-magnet (40) is mounted to said box for selectively moving said pin into and out of said recess (42) of the drive-slide (7) (FIGS. 6 and 9).

* * * * *